US007887000B2

(12) United States Patent
Siitonen et al.

(10) Patent No.: US 7,887,000 B2
(45) Date of Patent: Feb. 15, 2011

(54) COMPOSITE LIFTING ELEMENT OF A GRINDING MILL

(75) Inventors: Pekka Siitonen, Lempäälä (FI); Jari Liimatainen, Tampere (FI); Tage Möller, Skellefteå (SE); Klas-Göran Eriksson, Kåge (SE); Sture Persson, Skellefteå (SE)

(73) Assignee: Metso Minerals, Inc., Helsinki (FI)

( * ) Notice: Subject to any disclaimer, the term of this patent is extended or adjusted under 35 U.S.C. 154(b) by 38 days.

(21) Appl. No.: 12/083,685

(22) PCT Filed: Oct. 20, 2006

(86) PCT No.: PCT/FI2006/050452

§ 371 (c)(1),
(2), (4) Date: Jun. 10, 2008

(87) PCT Pub. No.: WO2007/048874

PCT Pub. Date: May 3, 2007

(65) Prior Publication Data

US 2009/0242675 A1 Oct. 1, 2009

(30) Foreign Application Priority Data

Oct. 24, 2005 (FI) ..... 20055569

(51) Int. Cl.
*B02C 17/22* (2006.01)

(52) U.S. Cl. ..... 241/183

(58) Field of Classification Search ..... 241/182, 241/183, 300, DIG. 30
See application file for complete search history.

(56) References Cited

U.S. PATENT DOCUMENTS

| | | | | | |
|---|---|---|---|---|---|
| 4,580,734 | A | * | 4/1986 | Eroskey et al. | 241/182 |
| 4,609,158 | A | * | 9/1986 | Wilson | 241/300 |
| 4,664,324 | A | | 5/1987 | Dopson | |
| 4,848,681 | A | | 7/1989 | Eriksson et al. | |
| 5,224,555 | A | | 7/1993 | Bain et al. | |
| 5,431,351 | A | * | 7/1995 | Lejonklou | 241/183 |
| 5,472,148 | A | | 12/1995 | Schaeffer | |
| 5,832,583 | A | * | 11/1998 | Wason | 29/401.1 |
| 6,036,127 | A | | 3/2000 | Moller | |

FOREIGN PATENT DOCUMENTS

| | | |
|---|---|---|
| EP | 0 325 666 A1 | 8/1989 |
| EP | 1 393 840 A1 | 3/2004 |
| JP | A-2001-165146 | 6/2001 |
| WO | WO 93/15839 A1 | 8/1993 |
| WO | WO 03/099443 A1 | 12/2003 |
| WO | WO 2004/039521 A1 | 5/2004 |

* cited by examiner

*Primary Examiner*—Faye Francis
(74) *Attorney, Agent, or Firm*—Oliff & Berridge, PLC

(57) ABSTRACT

A lifting element for a drum of a grinding mill to be used for grinding of ores and minerals. The lifting element is attachable to a frame of the drum and extending in the longitudinal direction of the drum. The lifting element includes a flexible body and a wear protection element located in the leading edge of the body with respect to the direction of rotation of the drum. The wear protection element includes at least two different parts manufactured of different materials having toughness and hardness different from each other.

14 Claims, 4 Drawing Sheets

COMPOSITE LIFTING ELEMENT OF A GRINDING MILL

BACKGROUND

The present invention concerns a lifting element acting as a part of a lining made of a flexible polymeric material for a grinding mill used for grinding ores and minerals. More precisely, the invention concerns a lifting element of a grinding mill, where the mechanical properties and wear resistance of the wear protection change, when the profile of said lifting element changes due to wear, so that the service life of the wear protection increases.

The inner surface of the drum of grinding mills is plated with a wear resistant lining protecting the drum against wear caused by the grinding. Wear is caused by the ore and rock material and by the elements used for grinding like grinding balls, bars or cylinders. Materials used for wear lining include elastomeric material like rubber, composition metals like steel, or a combination thereof. The wear lining comprises protective plates and lifting elements, said lifting elements being here later referred to as lifting bars. Lifting bars extend from one end of the drum to another, the bars being fastened to the frame of the drum and they mechanically lock the protective plates onto the surface of the drum. Lifting bars having the purpose to improve the rotation of the material to be ground and the grinding elements in the mill are located more projecting than the lining on the inner surface of the drum. Therefore they receive also most of the impact stress caused by the dropping grinding elements and grinding bodies and of the abrasive wear caused by the grinding. The wear of the lifting bars decreases their protective effect for the lining and has also influence on the energy consumption and grinding quality of the mill. Calculations have shown that the intensity of the impact wear subjected to the bar decreases when the profile of the bar lowers caused by the wear.

SUMMARY

Elastomers used for linings of mills and lifting bars have low resistance to grinding abrasion, but high resistance to impact stresses. Hard metallic linings like white cast iron have high resistance to abrasion but, due to their low toughness, they can be used only in smaller mills, with less impact stresses. With worked or cast steel based materials the impact strength is higher but the wear resistance is lower than with the white cast irons. A lifting bar having the best mechanical properties and wear resistance is provided by combining the elastomeric and metallic lining.

U.S. Pat. No. 5,431,351 discloses a lifting bar utilizing a metallic frame construction. U.S. Pat. No. 4,848,681 discloses a lifting bar made of an elastomeric material having the leading edge reinforced with a metallic layer.

Computer simulation has now been successfully used for modeling the grinding operation in the mill and thus defining the intensity of the impact stresses that the different parts of the lifting bar are exposed to, when the profile changes caused by the wear of the mill and the lifting height and trajectory of the material to be ground change. The results of the simulation have shown that when the lining wears, the intensity of the impact stresses decrease.

In the present invention, the lifting bar formed of polymer and metal is made of two or a plurality of metals, alloys or metallic and ceramic compounds connected to the polymeric frame so that different portions of the lifting bar are made of material with optimal mechanical properties and wear resistance.

With a lifting bar according to the invention, the following advantages can be provided:

- multiplied service life compared with the solutions of prior art can be achieved by optimizing the construction and design of the lifting bar,
- different wear in different portions of the mill can be taken into consideration by the construction and design of the lifting bar, whereby the simultaneous wear-out of the mill lining can be ensured,
- energy consumption with respect to the final product decreases, and
- utilization degree of the mill capacity increases due to the decreased need of service and less downtimes.

More precisely, the lifting element according to the invention is characterized by a flexible body and a wear protection element having at least two different parts manufactured of different materials having different toughness and hardness.

BRIEF DESCRIPTION OF THE DRAWINGS

The lifting element, in other words, the lifting bar according to the present invention, will be described by way of example in more detail in the following, with reference to the enclosed drawings, wherein.

DETAILED DESCRIPTION OF EMBODIMENTS

Figure 1:
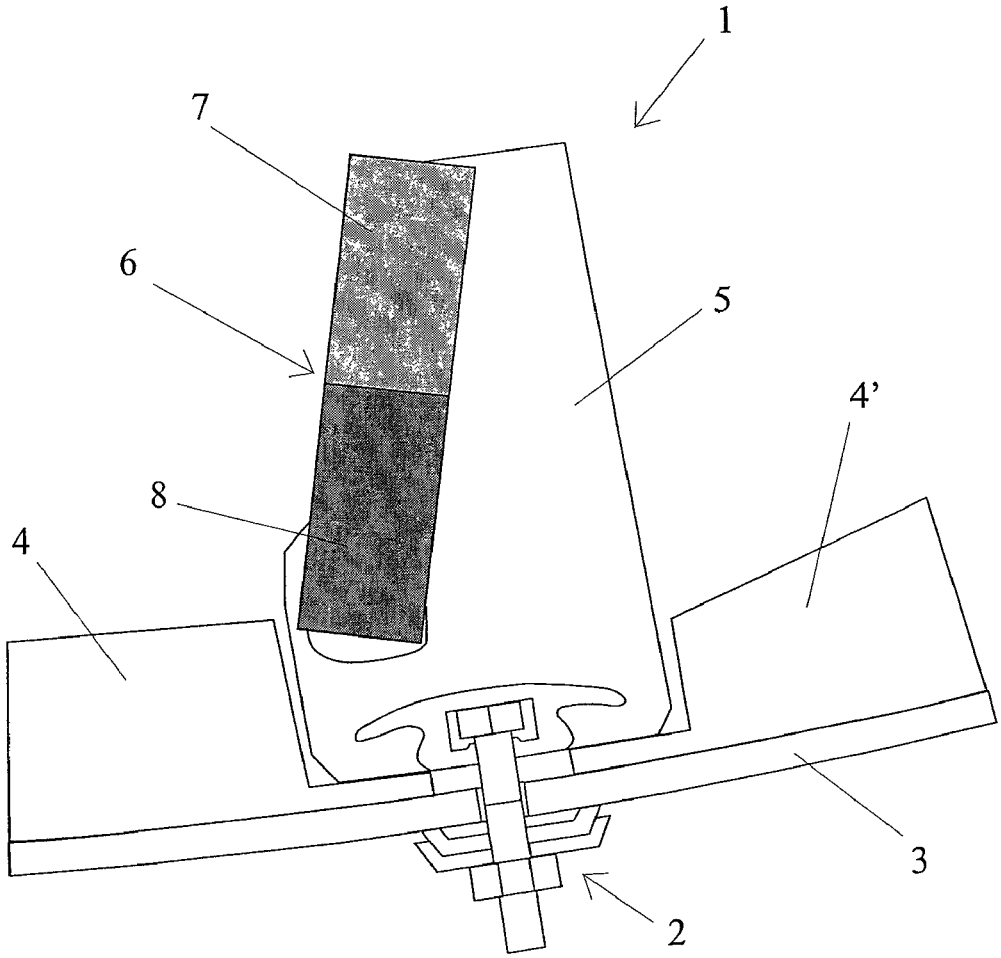
FIG. 1 shows one lifting bar according to the invention mounted in place on the inner surface of a grinding mill.

FIG. 1 shows one lifting bar 1 according to the invention as a partially cross-sectional view at the point where the fixing element 2 is located. The lifting bar 1 is attached to the frame 3 of the grinding mill with a fixing element 2. Pieces 4, 4' of polymeric material forming the wear lining are attached between the lifting bars, on the inner surface of the frame 3 of the mill. The lifting bar 1 consists of a frame 5 of polymeric material and a metallic reinforcement 6 reinforcing the leading edge of the lifting bar, acting as a wear protection element of the lifting bar. The metallic reinforcement 6 is comprised of two parts essentially on top of each other viewed from the base of the lifting bar, that is, of the upper part 7 made of material with lower hardness and higher toughness, and the lower part 8 made of material with higher hardness and lower toughness.

The metallic reinforcement 6 can be attached to the polymeric material body 5 for example with a mechanical joint or with an adhesive joint. The upper part 7 and the lower part 8 of the metallic reinforcement 6 are attached to each other with a metallurgic bond between the materials or with an adhesive joint.

In the solution according to the invention, shown in FIG. 1, the upper part 7 of the metallic reinforcement 6 of the lifting bar 1 receives the impact stresses of the elements used for grinding, in other words, those of the grinding bars and balls, and the material to be ground in the grinding process. In this receiving of impact stresses, also the flexible polymeric material frame 5 of the lifting bar is of help. The abrasive wear, in other words, the grinding wear in the grinding process is mainly exerted to the base part of the lifting bar 1, at the area of the lower part 8 of the metallic reinforcement 6, which the hard material of the lower part 8 resists well.

The material of the upper part 7 of the metallic reinforcement 6 can be for example:

casting steel like Cr—Mo alloyed quenched and tempered steel worked wear-resistant steel, having a hardness of 450-600 HV, or powder metallurgic tool steel, being characterized of low carbon content, low alloying and toughness The material of the lower part 8 of the metallic reinforcement can be for example of:

powder metallurgic tool steel, being characterized of high carbon content, high alloying, hardness and wear resistance, metallic matrix composite produced with a powder metallurgic method, like metal+ceramic composite (like tool steel+wolfram carbide (WC), tool steel+hard metal (Co+WC), cast steel+WC) or metal+metallic composite (like tool steel+manganese steel), or white cast iron.

Figure 2:
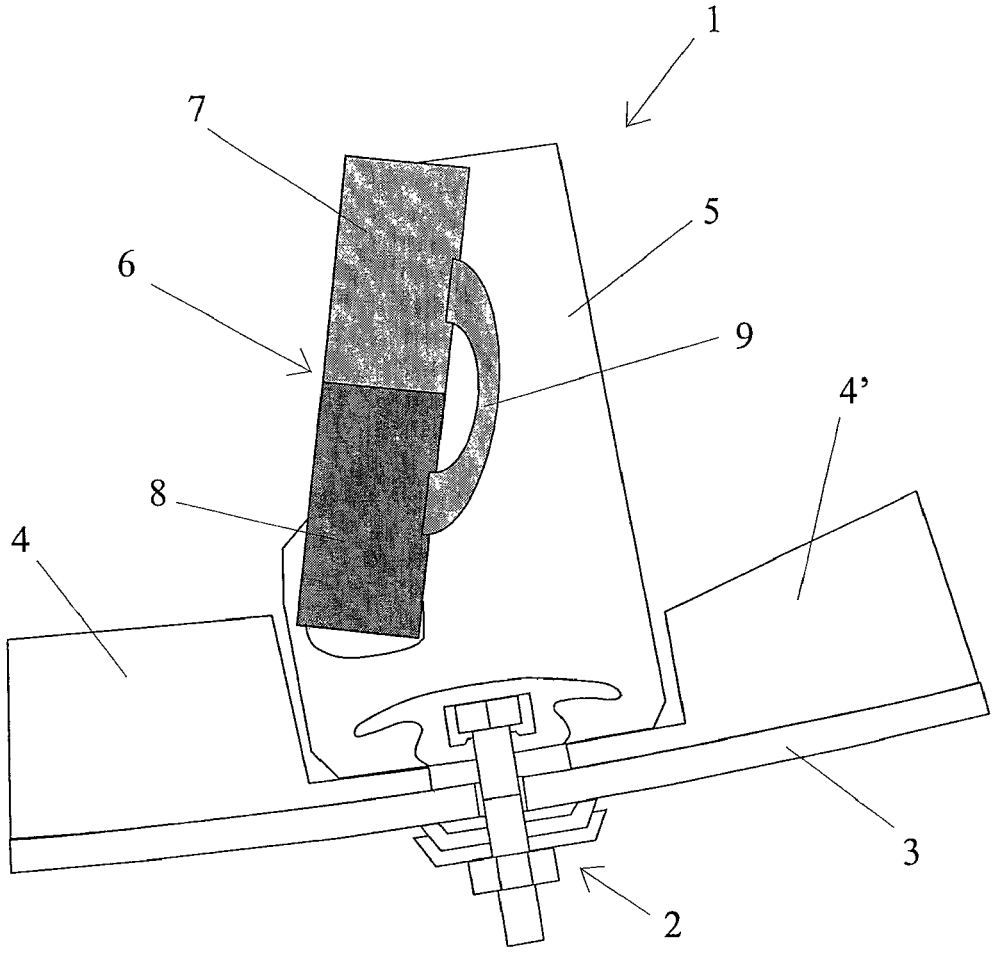
FIG. 2 shows an alternative embodiment of the lifting bar according to the invention.

FIG. 2 shows one alternative embodiment of the lifting bar according to the present invention, having an attaching part 9 added to the metallic reinforcement 6 according to the FIG. 1. The attaching part 9 is for ensuring the attachment of the metallic reinforcement 6 to the polymeric material body 5. In addition, the attaching part 9 can be utilized when handling the metallic reinforcement 6 i.a. when mounting it in place in the mold in connection with the production of the lifting bar.

Figure 3A:
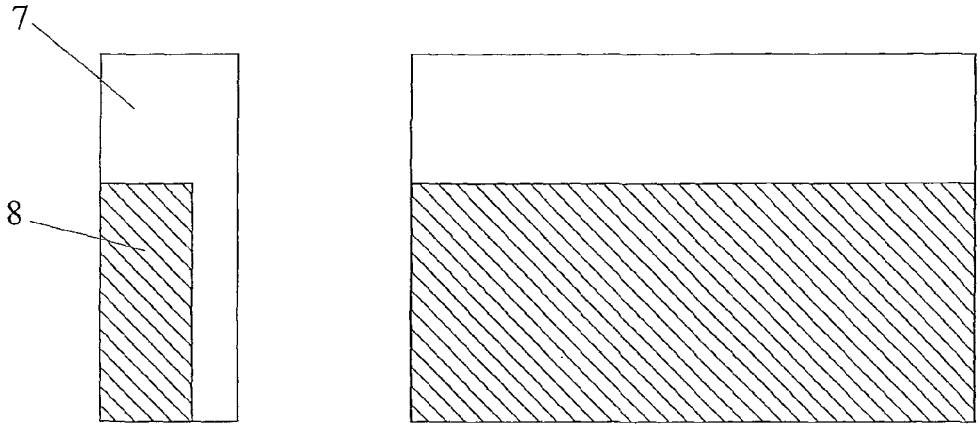
FIGS. 3*a-c* show examples of alternative embodiments of the metallic reinforcement of the lifting bar according to the invention.
Figure 3B:
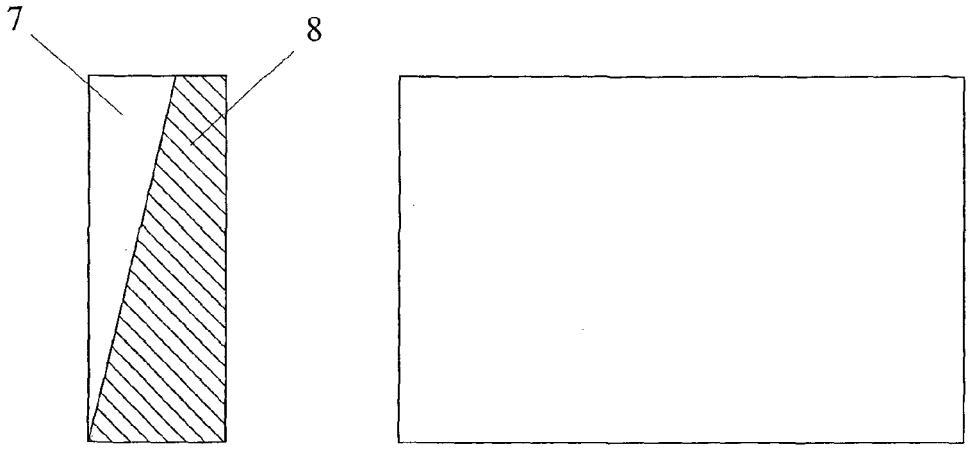
Figure 3C:
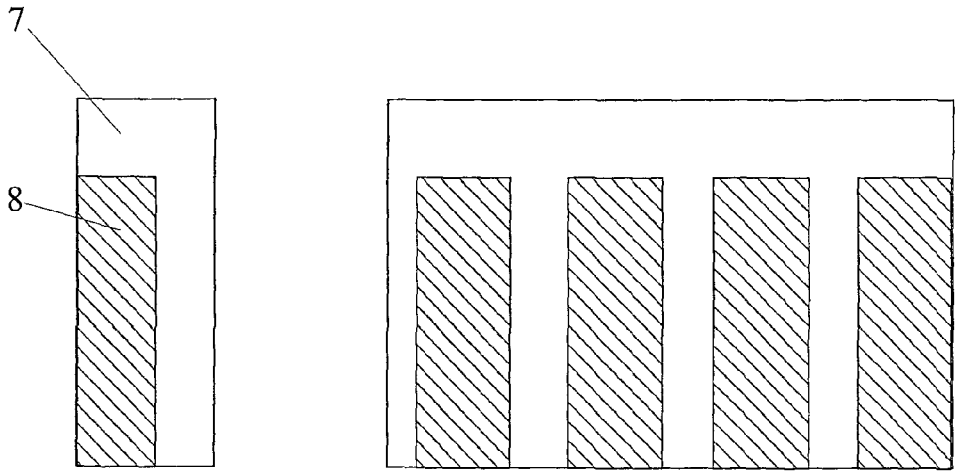
Figure 4A:
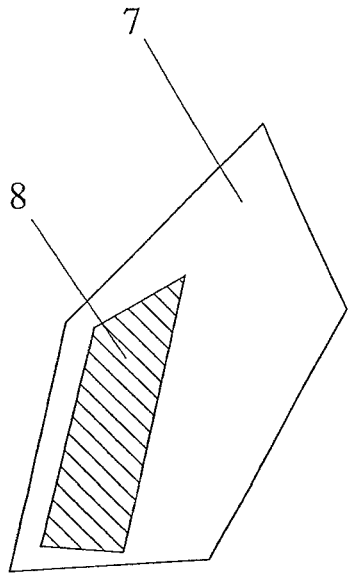
FIGS. 4*a-d* show alternative cross-sectional profiles of the metallic reinforcement of the lifting bar according to the invention.
Figure 4B:
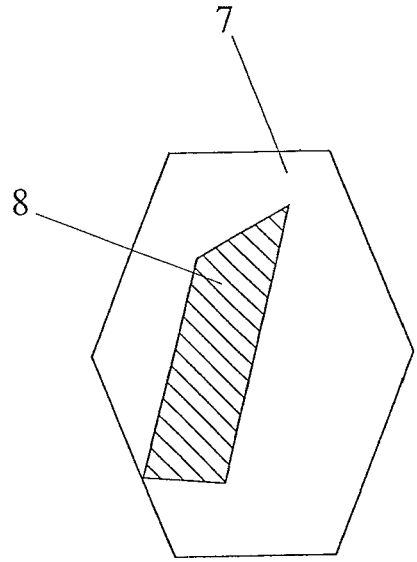
Figure 4C:
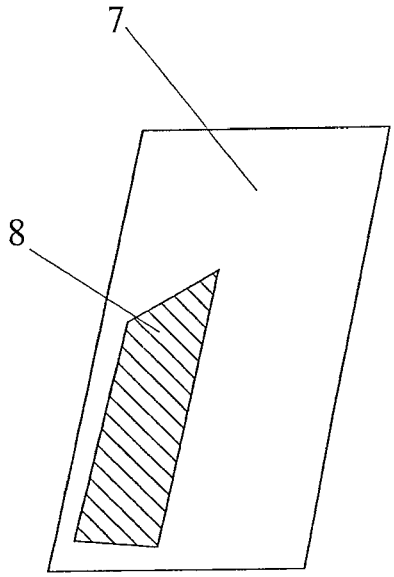
Figure 4D:
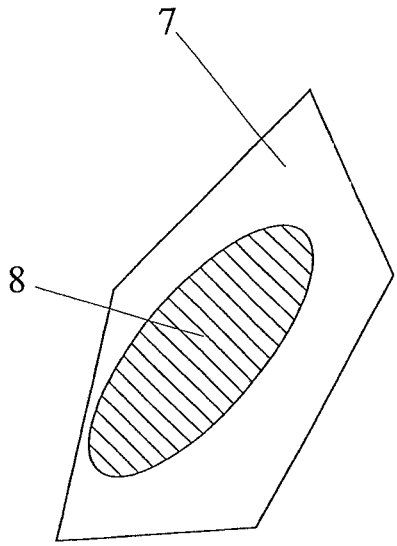

Figures from 3*a* to *c* show examples of the construction of the metallic reinforcement forming the wear protection element of the lifting bar according to the invention, as a cross-sectional view and as a front view. In the example of FIG. 3*a*, the part 8 manufactured of wear resistant material is placed onto the lower part of the metallic reinforcement, the rest of the metallic reinforcement being the portion 7 made of tough material. In the example of FIG. 3*b*, the portion of the piece 8 manufactured of wear resistant material in the cross-sectional area of the metallic reinforcement increases when moving from up downwards in the reinforcement. In this example, when the part 7 made of tough material wears at the lower edge of the metallic reinforcement, where the abrasive wear is the strongest, the wear resistant material comes out along with the progressive wear. FIG. 3*c* shows an example, where the part 8 made of wear resistant material has been placed piece by piece in the metallic reinforcement, at desired distances in the longitudinal direction of the reinforcement.

FIGS. 4*a-d* show alternative cross-sectional profiles of the metallic reinforcement of a lifting bar according to the present invention. These cross-sectional profiles show, that in the solution according to the invention, the metallic reinforcement needs not to have a rectangular form, but it can also be implemented with different profile forms. In addition, these figures show one embodiment according to the present invention, where the part 8 made of a wear resistant material is located inside the part 7 made of tough material, from where it comes out as a result of the wear of the metallic reinforcement, at the areas of the strongest wear. In this way a metallic reinforcement of a lifting bar can be provided, having properties changing and improving along with the progressing wear.

The materials for the wear protection element of a lifting bar in accordance with the present invention can advantageously be manufactured with a powder metallurgical method, like for example by compacting the powder raw materials by means of hot isostatic pressing, whereby the powder(s) are compacted by means of temperature and pressure. If necessary, the material can be further processed for example by hot working or by forming. Another suitable powder metallurgic method is the melt deposition. In addition, in the manufacture of powder metallurgic materials, the methods described above can be combined, if necessary.

The material or materials for the wear protection element of the lifting bar can also be manufactured by casting or by deposition welding. Suitable deposition welding methods are i.a. the PTA welding (Plasma Transferred Arc) and the submerged arch welding.

The materials for the wear protection element of the lifting bar can also be joined by means of hot isostatic pressing or hot forging.

The invention claimed is:

1. A lifting element for a drum of a grinding mill to be used for grinding of ores and minerals, said lifting element being attachable to a frame of the drum and extending in the longitudinal direction of the drum, and said lifting element comprising a flexible body made of a polymeric material and a wear protection element located in a leading edge of the body with respect to a direction of rotation of the drum when attached thereto, wherein:

the wear protection element consists of at least two different parts, said parts being metallic reinforcements manufactured of different materials having a toughness and hardness different from each other, and the part of the wear protection element manufactured of a harder material is located:

in a lower part of a leading edge of the part manufactured of a tougher material, at least partly under the part manufactured of the tougher material, or at least partly inside the part manufactured of the tougher material.

2. A lifting element according to claim 1, wherein the part of the wear protection element manufactured of the harder material is located in the lower part of the leading edge of the part manufactured of the tougher material.

3. A lifting element according to claim 1, wherein the part of the wear protection element manufactured of the harder material is located at least partly under the part manufactured of the tougher material.

4. A lifting element according to claim 1, wherein the part of the wear protection element manufactured of the harder material is located at least partly inside the part manufactured of the tougher material.

5. A lifting element according to claim 1, wherein at least one of the materials of the wear protection element is manufactured of raw-material produced with a powder metallurgic process.

6. A lifting element according to claim 5, wherein the material manufactured with a powder metallurgic method is a powder metallurgic high-speed steel or a tool steel.

7. A lifting element according to claim 5, wherein the material manufactured with a powder metallurgic method is a wear resistant composite material.

8. A lifting element according to claim 1, wherein at least one of the materials of the wear protection element is a cast material manufactured by casting.

9. A lifting element according to claim 1, wherein at least one of the materials of the wear protection element has been manufactured with deposition welding.

10. A lifting element according to claim 1, wherein the materials of the wear protection element are joined with each other by temperature and pressure.

11. A lifting element according to claim 1, wherein the materials of the wear protection element are joined with each other by an adhesive joint.

12. A lifting element according to claim 1, wherein the wear protection element is a melt deposited element manufactured by melt deposition.

13. A lifting element according to claim 1, wherein the wear protection is a cast element manufactured by a casting technique.

14. A lifting element for a drum of a grinding mill to be used for grinding of ores and minerals, said lifting element being attachable to a frame of the drum and extending in the longitudinal direction of the drum, and said lifting element comprising a flexible body made of a polymeric material and a wear protection element located in a leading edge of the body with respect to a direction of rotation of the drum when attached thereto, wherein:

the wear protection element consists of at least two different parts, said parts being metallic reinforcements manufactured of different materials having a toughness and hardness different from each other, when viewed from a base of the lifting element, the wear protection element is divided into an upper part and a lower part, said parts being located substantially on top of each other, and the upper part of the wear protection element is manufactured of a material having higher toughness and lower hardness than a material of which the lower part of the wear protection element is manufactured.

* * * * *